United States Patent [19]

Thompson

[11] 4,323,020

[45] Apr. 6, 1982

[54] APPARATUS FOR OVERCOMING SEWING MACHINE NEEDLE BIND

[75] Inventor: Elmer R. Thompson, Lubbock, Tex.

[73] Assignee: Datho Mfg. Inc., Lubbock, Tex.

[21] Appl. No.: 185,319

[22] Filed: Sep. 8, 1980

[51] Int. Cl.[3] ..... D05B 27/24; D05B 29/02; D05B 15/00

[52] U.S. Cl. ..... 112/61; 112/237; 112/310

[58] Field of Search ..... 112/237, 238, 310, 235

[56] References Cited

U.S. PATENT DOCUMENTS

| | | | |
|---|---|---|---|
| 571,053 | 11/1896 | Scetrini et al. | 112/61 |
| 1,431,479 | 10/1922 | Miller | 112/61 |
| 2,408,523 | 10/1946 | Leveque | 112/61 |
| 2,527,196 | 10/1950 | Pedersen | 112/61 |
| 2,754,783 | 7/1956 | Scott et al. | 112/237 |
| 2,986,105 | 5/1961 | Maxant | 112/237 X |

*Primary Examiner*—H. Hampton Hunter
*Attorney, Agent, or Firm*—E. Harrison Gilbert, III

[57] ABSTRACT

An apparatus for limiting the displacement of a presser bar reciprocatingly mounted in a frame of a sewing machine is disclosed to include a contact member for contacting the presser bar after the presser bar has moved a predetermined distance. The apparatus further includes a latch member, having the contact member associating therewith, for releasably engaging the frame of the sewing machine so that the contact member is prevented from moving in the same direction as the presser bar. So that the latch member may be disengaged from the frame, the present invention also includes a mechanism for decoupling the latch member. The apparatus further includes a mechanism for positioning the latch member so that different portions of the contact member overlie the path of movement of the presser bar during different portions of a stitching cycle.

12 Claims, 5 Drawing Figures

APPARATUS FOR OVERCOMING SEWING MACHINE NEEDLE BIND

BACKGROUND OF THE INVENTION

This invention relates generally to apparatus for preventing or overcoming binding which can occur between a sewing machine needle and material that is being sewn thereby. The invention relates more particularly, but not by way of limitation, to devices which prevent or limit the upward movement of a presser bar of a sewing machine when the material being sewn becomes bound with the sewing machine needle.

When a sewing machine is used to sew such a material as leather, the sewing machine needle can bind with the material and pull it upward away from the workpiece support table of the sewing machine as the needle is retracted from its stitch-producing position. The adherence of the material to the needle is often sufficiently strong to overcome the downward force exerted by a presser bar and an accompanying presser foot which form part of the sewing machine.

This binding and upward movement of the material is troublesome to the sewing machine operator because the sewing operation must be interrupted to manually separate the material from the needle so that proper sewing can proceed. Additionally, when the material overcomes the force exerted by the presser bar and foot, the two pieces of material to be sewn together become misaligned. This misalignment likewise slows the operation because the operator must take additional time to realign the two pieces of material.

Therefore, there is a need for an apparatus which can be attached to or incorporated with a sewing machine for preventing or overcoming the binding force which can arise between a sewing machine needle and the material to be sewn. More specifically, there is the need for an apparatus for limiting the displacement of a presser bar and its accompanying presser foot so that they will not be excessively moved should binding occur. Such an apparatus is particularly needed on domestic sewing machines which are not originally constructed to overcome binding which may occur between the needle and the material to be sewn.

Although I have proposed other types of sewing machine conversion apparatus for converting a domestic machine into one capable of sewing relatively heavier materials (see my copending U.S. patent application Ser. No. 081,345 filed Oct. 3, 1979, my U.S. patent application Ser. No. 159,109 filed June 13, 1980, and my U.S. Pat. No. 3,952,675 issued Apr. 22, 1976), none of these meets the aforementioned needs. I am aware of no other proposed or constructed devices which meet these needs.

SUMMARY OF THE INVENTION

The present invention overcomes the above-noted and other shortcomings of the prior art by providing a novel and improved apparatus for overcoming sewing machine needle bind. This invention reduces or eliminates the interruptions in the operation of the sewing machine resulting from binding of the sewing machine needle and the material to be sewn. Likewise, the present invention reduces the misalignment which can arise during periods of binding.

The present invention meets these needs by providing an apparatus for limiting the displacement of a presser bar reciprocatingly mounted within a frame of a sewing machine. The apparatus comprises contact means for contacting the presser bar after the presser bar has moved a predetermined distance; latch means having the contact means associated therewith, for releasably engaging the frame so that the contact means is prevented from moving in the same direction as the presser bar; and decoupling means for disengaging the latch means from the frame. The present invention further comprises positioning means for orienting the contact means so a first portion thereof extends across a projection of the path of the presser bar during a first period of operation of the sewing machine and for shifting the contact means so that a second portion of the contact means extends across the projection of the path during a second period of operation of the sewing machine.

The contact means includes a member having a surface extending obliquely to the direction of movement of the presser bar.

The decoupling means includes a decoupling member pivotally connected to the latch means. The decoupling member has a portion which engages the frame during pivotation of the decoupling member. The decoupling means also includes pivot means for pivoting the decoupling member so that the portion of the decoupling member engages the frame and disengages the latch means from the frame.

From the foregoing it is a general object of the present invention to provide a novel and improved apparatus for overcoming sewing machine needle bind. Other and further objects, features and advantages of the present invention will be readily apparent to those skilled in the art when the following description of the preferred embodiment is read in conjunction with the accompanying drawings.

DETAILED DESCRIPTION OF A PREFERRED EMBODIMENT OF THE PRESENT INVENTION

Figure 1:
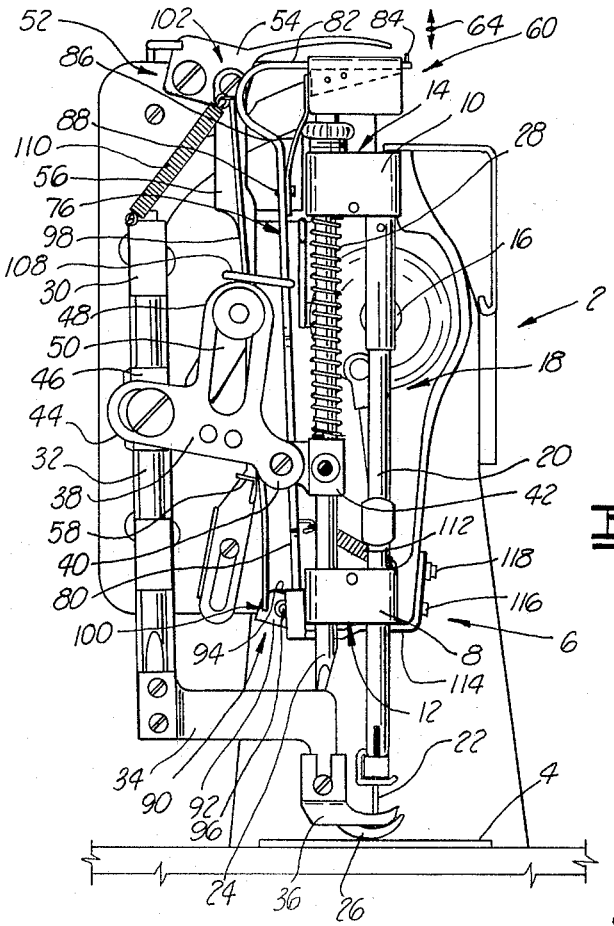
FIG. 1 is an end elevational view of a sewing machine having a preferred embodiment of the present invention attached thereto.

With reference to the drawings a preferred embodiment of the present invention will be described. Initially, however, a sewing machine 2 with which the present invention can be used will be described. It is to be noted that the sewing machine may be any of the types described in my co-pending U.S. patent applications, Ser. No. 081,345 filed Oct. 3, 1979 and Ser. No. 159,109 filed June 13, 1980, or in my U.S. Pat. No. 3,952,675 issued Apr. 27, 1976. The present invention may also be used with other suitable types of sewing machines.

The particular embodiment of the sewing machine 2 with which the present invention will be described is shown in FIGS. 1–4. The sewing machine 2 includes a workpiece support table 4 upon which a workpiece (i.e., the material to be sewn) is supported and across which the workpiece is moved.

The sewing machine 2 also includes a frame 6 having a first yoke member 8 and a second yoke member 10 extending therefrom so that a first surface 12 of the first yoke member 8 substantially faces the workpiece support table 4 and so that a second surface 14 of the second yoke member 10 substantially faces away from the workpiece support table 4.

The sewing machine 2 further includes a lift rod (not shown) and a feed rod (not shown) which are responsive to a main crankshaft 16 for coordinating the movement of parts of the sewing machine during each sewing or stitching cycle which occurs for each revolution of the main crankshaft 16.

The main crankshaft 16 has a wheel-and-arm assembly 18 attached to one end thereof for reciprocating a needle bar 20 and a needle 22 attached thereto. FIG. 1 discloses that the needle bar 20 is movably mounted in aligned openings formed in the first and second yoke members 8 and 10.

Reciprocatingly mounted in two other aligned holes formed in the first and second yoke members 8 and 10 is a presser bar 24 having a presser foot 26 extending from the lower end thereof. The presser foot 26 holds the material to be sewn against the workpiece support table 4 during the stitching of the material. The force exerted by the presser foot 26 is maintained by a biasing member, such as a spring 28 shown in FIG. 1.

The sewing machine 2 has pivotally mounted thereto a tubular member 30 having a workpiece retainer rod 32 movably retained therein. The tubular member 30 pivots in response to movement of the feed rod. An ankle member 34 and a feed foot 36 are attached to the lower end of the workpiece retainer rod 32. The workpiece retainer rod 32, ankle member 34 and feed foot 36 are reciprocatingly moved in conjunction with a feed dog (not shown) positioned beneath the workpiece support table 4 for incrementally advancing the material during each stitching cycle.

The reciprocating action of both the presser bar 24 and the workpiece retainer rod 32 is provided through a bell crank 38 having a first end 40 connected to a collar 42 secured to the presser bar 24 and having a second end 44 connected to a block 46 secured to the workpiece retainer rod 32. A third end 48 of the bell crank 38 is associated with means for communicating movement by the lift rod to the bell crank. In the preferred embodiment the lift rod movement communicating means includes a crank rod 50 coupled to the lift rod.

Figure 4:
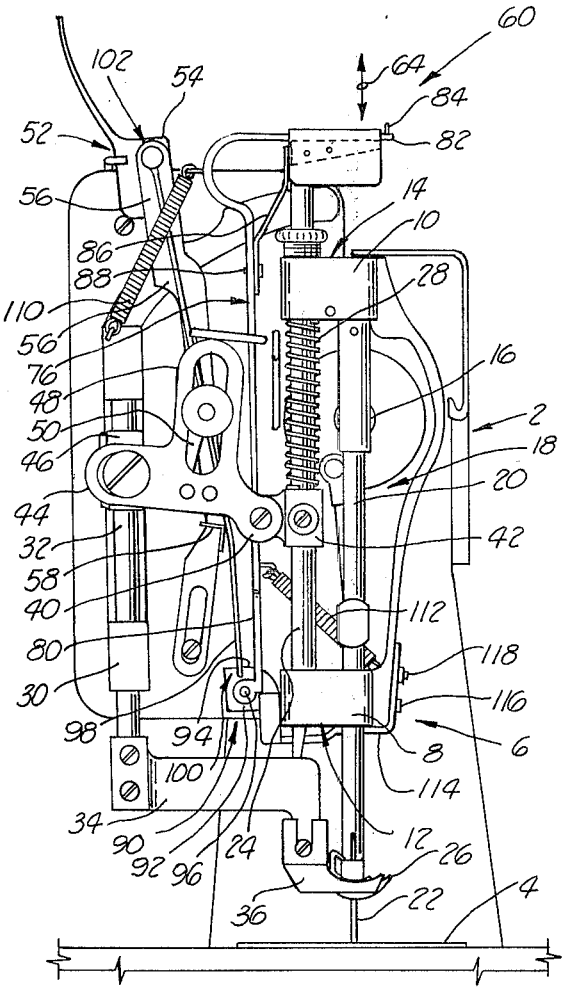
FIG. 4 is an end elevational view of the sewing machine having its lift mechanism actuated.

The sewing machine 2 further includes a lift mechanism 52 including a lift lever 54, a lift bar 56 and a lift shoulder 58 extending from the lift bar 56. When the lift mechanism 52 is actuated by raising the lift lever 54, the lift shoulder 58 engages the bell crank 38 and raises it thereby raising the presser bar 24, the workpiece retaining bar 32 and the associated appendages as illustrated in FIG. 4.

During the operation of the sewing machine 2, the main crankshaft 16 rotates under either manual or powered drive force to drive the needle 22 downward through the material so that a stitch is formed in the material and then to retract the needle 22 therefrom so that the material can be advanced. During the stitching of the material by the needle 22, the lift rod moves the bell crank 38 so that the presser bar 24 and the attached presser foot 26 are lowered to press the material against the workpiece support table 4. The pressure resulting from the lowered presser bar 24 and presser foot 26 holds the material in alignment.

As the crankshaft 16 continues its rotation, the needle 22 is retracted from the material and the lift rod moves the bell crank 38 to the left as viewed in the drawings thereby raising the presser bar 24 and presser foot 26. During this portion of the stitching cycle the workpiece retainer rod 32 and the feed foot 36 are lowered to retain the material against the feed dog. During engagement of the material with the feed dog, the tubular member 30 is rotated by the feed rod so that the material is advanced in preparation of a new stitching cycle.

It is during the portion of the stitching cycle when the needle 22 is being retracted and the presser bar 24 is being raised, that binding between the needle 22 and the material can occur. If the binding is sufficiently strong, the material will be drawn upward against the presser foot 26 forcing the presser foot 26 to a higher longitudinal displacement than ordinarily occurs. This higher than normal displacement causes the material to become misaligned because the feed foot 36 has not yet been lowered into its workpiece retaining position.

To prevent or overcome this binding between the needle 22 and the material, the present invention is attached or incorporated with the sewing machine 2. The present invention specifically provides an apparatus for limiting the longitudinal displacement of the presser bar 26 which is reciprocatingly mounted in the frame 6, particularly the yoke members 8 and 10.

Figure 5:
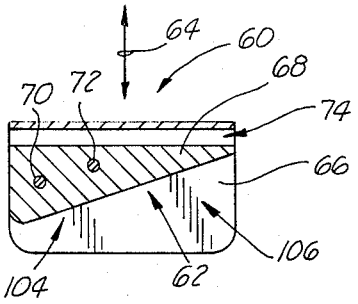
FIG. 5 is a sectional view of the contact means of the preferred embodiment of the present invention.

The apparatus includes contact means for contacting the presser bar 24 after the presser bar 24 has moved longitudinally a predetermined distance. The contact means includes a blocking member 60 having an inclined surface 62 extending obliquely to the longitudinal direction of movement of the presser bar 24. The longitudinal direction of movement of the presser bar 24 is depicted by the arrow labeled with the reference numeral 64. FIG. 5 particularly discloses the preferred embodiment of the blocking member 60 includes a housing 66 having a wedge-shaped member 68 retained therein by two retaining pins 70 and 72. A channel 74 is defined between the upper portion of the wedge-shaped member 68 and the underside of the housing 66 as the blocking member 60 is oriented in FIG. 5.

Figure 2:
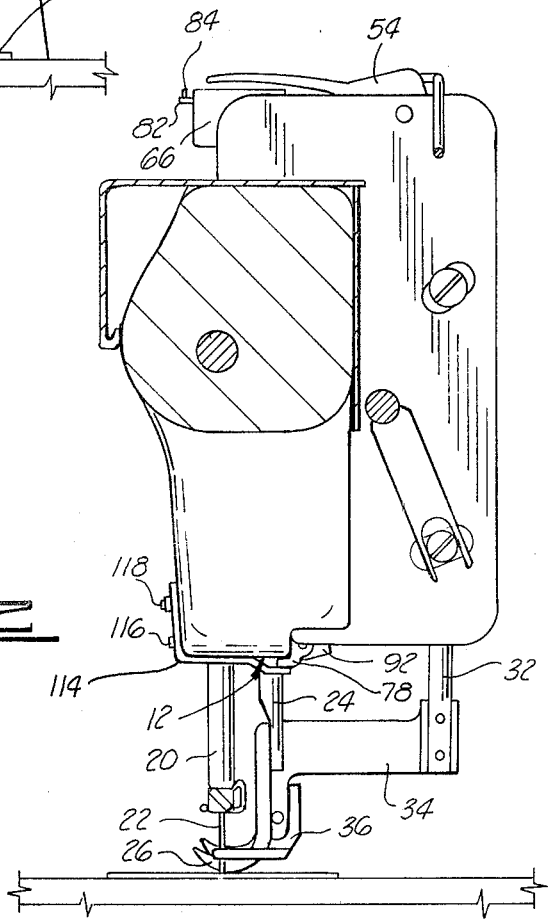
FIG. 2 is a sectional view of the sewing machine taken from the rear of the end shown in FIG. 1.

The apparatus further includes latch means, having the contacting means associated therewith, for releasably engaging the frame 6 of the sewing machine 2 so that the contacting means is prevented from moving in the same longitudinal direction as the presser bar 24 moves during the stitching cycle. As shown in FIGS. 1 and 2 the latch means particularly includes in the preferred embodiment a latch bar 76 having a latch foot 78 extending therefrom for engaging the frame 6 to prevent longitudinal movement of the latch bar 76. For the embodiment depicted in the drawings, the latch foot 78 extends from a central portion 80 of the latch bar 76 so that it engages the first yoke member 8 adjacent the first surface 12 thereof. This secures the latch bar 76 so that it does not move in a direction away from the workpiece supporting table 4.

The latch bar 76 further includes a support arm 82 extending therefrom in overlying relation to the end of the presser bar 24 opposite the presser foot end. More particularly, the support arm 82 extends in overlying, spaced relation to the second surface 14 of the second yoke member 10. The support arm 82 passes through the channel 74 defined in the blocking member 60 so that the blocking member 60 likewise overlies the presser bar 24 and the second surface 14 of the second yoke member 10. To properly position the blocking member 60 on the support arm 82, the latch bar 76 has both a retaining pin 84 fastened therein and a resilient retaining member 86 connected thereto as by a screw 88 or other suitable means.

The apparatus further includes decoupling means for disengaging the latch means from the frame 6. The preferred embodiment decoupling means includes a decoupling member 90 pivotally connected to the latch means (in particular, to the latch bar 76) for being pivoted against the first yoke member 8. In the preferred embodiment the decoupling member 90 includes a cam-like element 92 having a curved edge 94 for engaging a side of the first yoke member 8 extending substantially perpendicular to the first surface 12 thereof. The cam-like element 92 is pivotally connected to the latch bar 76 adjacent the latch foot 78 by means of a pin 96.

The decoupling means further includes pivot means for pivoting the decoupling member 90 so that the curved portion 94 thereof engages the frame 6 of the sewing machine 2 and disengages the latch means from the frame 6. The pivot means includes a decoupling rod 98 having a first end 100 pivotally connected to the decoupling member 90 and having a second end 102 pivotally connected to the lift mechanism 52, and in particular the lift lever 54, so that the decoupling member 90 pivots and engages the frame 6 to disengage the latch foot 78 therefrom when the lift mechanism 52 is actuated.

The present invention further includes positioning means for orienting the blocking member 60 so that a first portion 104 of the inclined surface 62 extends across a projection of the longitudinal path of the presser bar 24 during a first period of operation of the sewing machine 2 and for shifting the blocking member 60 so that a second portion 106 of the surface 62 extends across the projection of the longitudinal path during a second period of operation of the sewing machine. In the preferred embodiment the positioning means includes a connector element 108 which is secured to the bell crank 38 and is slidably engaged with the latch bar 76. As the main crankshaft 16 rotates, the bell crank 38 rotates in response thereto via the lift rod so that the connector element 108 pivots the latch bar 76 substantially about the line of engagement between the latch foot 78 and the first yoke member 8. The pivoting is clockwise (as viewed in the drawings) during a first portion of each revolution of the main crankshaft 16 so that the first portion 104 of the surface 62 extends across the projection of the path of movement of the presser bar 24, and the pivoting is counterclockwise during a second portion of each revolution of the main crankshaft 16 so that the second portion 106 of the surface 62 extends across the projected path of presser bar travel.

The apparatus of the present invention further includes means for connecting the latch bar 76 to the sewing machine 2. The connecting means includes biasing means particularly disclosed as a first spring 110 and a second spring 112 connected by suitable means to the sewing machine 2 and to the latch bar 76. The connecting means further includes a bottom retaining member 114 secured to the frame 6 of the sewing machine 2, such as by screws 116 and 118, so that a portion of the member 114 extends below the latch foot 78 when it is engaged with the first yoke member 8.

Figure 3:
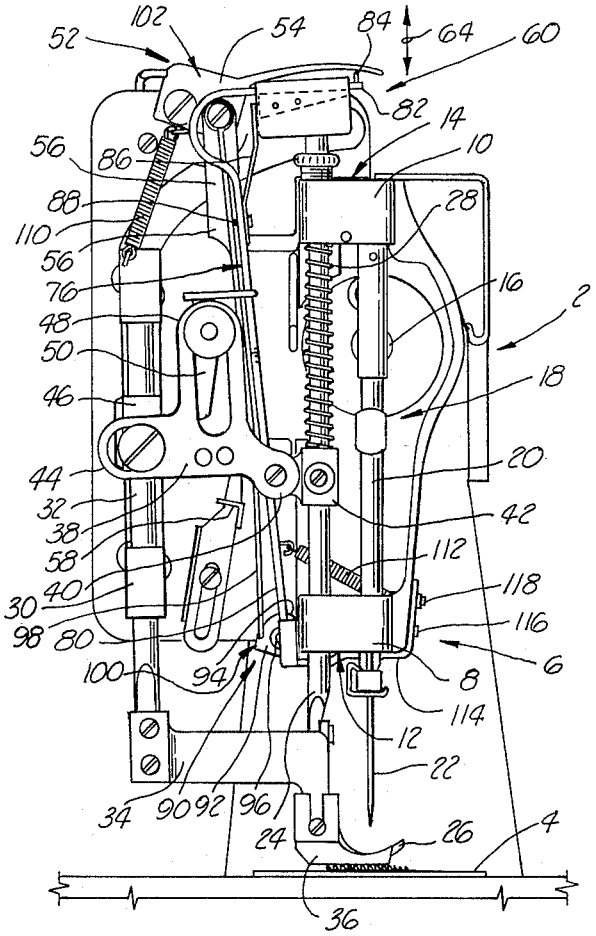
FIG. 3 is an end elevational view of the sewing machine having its needle in a position different than that shown in FIG. 1.

The operation of the present invention will be described with reference primarily to FIGS. 1, 3 and 4. In FIG. 1 the needle 22 is commencing its upward movement as the crankshaft 16 and the wheel-and-arm assembly 18 connected thereto move in a clockwise direction as viewed in FIG. 1. With the needle 22 in this position, the bell crank 38 is canted to the right so that the latch bar 76 is held in its right-most position thereby placing the first portion 104 of the obliquely extending surface 62 of the blocking member 60 above the top of the presser bar 24. Because of the inclination of the surface 62, the first portion 104 thereof is relatively closer to the presser bar 24 than is the second portion 106 thereof. With the first portion 104 so positioned over the presser bar 24, the upward longitudinal movement of the presser bar 24 is limited to the predetermined distance defined by the inclined surface 62. Therefore, if binding should occur between the needle 22 and the workpiece during this period of upward needle movement, the presser bar 24 will only be forced up the limited predetermined distance before the rigidly held blocking member 60 contacts the presser bar and resists or overcomes the binding force.

Once the needle 22 has been retracted, it is necessary to permit the presser bar 24 to be raised to a higher level so that the workpiece can be fed by means of the feed foot 36 and feed dog during the normal stitching cycle. FIG. 3 depicts that when this portion of the stitching cycle is reached, the lift rod has moved the bell crank 38, and consequently the latch bar 76 connected thereto by means of the connector 108, to the left. The leftward pivotation of the latch bar 76 likewise shifts the blocking member 60 to the left so that the second portion 106 of the inclined surface 62 is now above the movement path of the presser bar 24. Because of the inclination of the surface 62, the presser bar 24 can move to a greater height than is allowed by the first portion 104.

As the main crankshaft 16 continues to rotate clockwise, the lift rod responds thereto and returns the bell crank 38 to its right-most position to commence a new stitching cycle.

Because it is desirable at times to lift the entire presser foot/feed foot assembly away from the workpiece support table 4, it is necessary to provide means for releasing the latch bar so that this upward movement can be achieved. This is provided by the decoupling means having the decoupling member 90 and decoupling rod 98 associated with the lift mechanism 52. As shown in FIG. 4 when the lift lever 54 is raised, the decoupling rod 98 moves relatively upward thereby pivoting the cam-like element 92 about its pivoted joint with the latch bar 76 into engagement with the side of the first yoke member 8. As the cam-like element 92 pivots, the curved edge 94 engages the side of the first yoke member 8 thereby moving the latch foot 78 from beneath the first yoke member 8. With the latch foot 78 so released, the entire presser foot/feed foot assembly can be raised.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for limiting the displacement of a presser bar reciprocatingly mounted in a frame of a sewing machine, said apparatus comprising:

contact means for contacting the presser bar after the presser bar has moved a predetermined distance;

latch means, having said contact means associated therewith, for releasably engaging the frame so that said contact means is prevented from moving in the same direction as the presser bar; and decoupling means for disengaging said latch means from the frame.

2. An apparatus as defined in claim 1, wherein said contact means includes a member having a surface extending obliquely to the direction of movement of the presser bar.

3. An apparatus as defined in claim 2, further comprising positioning means for orienting said member so that a first portion of said surface extends across a projection of the path of the presser bar during a first period of operation of the sewing machine and for shifting said member so that a second portion of said surface extends across the projection of the path of the presser bar during a second period of operation of the sewing machine.

4. An apparatus as described in claim 2, wherein said decoupling means includes:

a decoupling member pivotally connected to said latch means, said decoupling member having a portion which engages the frame of the sewing machine during pivotation of said decoupling member; and pivot means for pivoting said decoupling member so that the portion thereof engages the frame and disengages the latch means from the frame.

5. An apparatus as defined in claim 4, further comprising positioning means for orienting said member so that a first portion of said surface extends across a projection of the path of the presser bar during a first period of operation of the sewing machine and for shifting said member so that a second portion of said surface extends across the projection of the path of the presser bar during a second period of operation of the sewing machine.

6. An apparatus as defined in claim 1, wherein said decoupling means includes:

a decoupling member pivotally connected to said latch means, said decoupling member having a portion which engages the frame of the sewing machine during pivotation of said decoupling member; and pivot means for pivoting said decoupling member so that the portion thereof engages the frame and disengages the latch means from the frame.

7. An apparatus as defined in claim 6, further comprising positioning means for orienting said member so that a first portion of said surface extends across a projection of the path of the presser bar during a first period of operation of the sewing machine and for shifting said member so that a second portion of said surface extends across the projection of the path of the presser bar during a second period of operation of the sewing machine.

8. An apparatus as defined in claim 1, further comprising positioning means for orienting said decoupling means so that said decoupling means is in a first position relative to the presser bar during a first period of operation of the sewing machine and is in a second position relative to the presser bar during a second period of operation of the sewing machine.

9. An apparatus for limiting the longitudinal displacement of a presser bar having a presser foot extending from one end thereof, said presser bar mounted in a frame of a sewing machine for reciprocating movement therethrough in response to rotation of a main crankshaft of the sewing machine and for lifting movement therethrough in response to movement of a lift mechanism of the sewing machine, said apparatus comprising:

a latch bar having a latch foot extending therefrom for engaging the frame of the sewing machine to prevent longitudinal movement of said latch bar, said latch bar also having a support arm extending therefrom in overlying relation to the end of the presser bar opposite the presser foot end;

a blocking member connected to the support arm of said latch bar, said blocking member having a surface extending obliquely to the longitudinal direction of movement of the presser bar;

a decoupling member pivotally connected to said latch bar; and a decoupling rod having a first end pivotally connected to said decoupling member and having a second end pivotally connected to the lift mechanism so that said decoupling member pivots and engages the frame to disengage said latch foot therefrom when the lift mechanism is actuated.

10. An apparatus as defined in claim 9, further comprising positioning means, responsive to rotation of the main crankshaft, for orienting said blocking member so that a first portion of the surface thereof extends across a projection of the longitudinal path of movement of the presser bar during a first portion of a revolution of the main crankshaft and for shifting said blocking member so that a second portion of the surface thereof extends across the projection of the longitudinal path of movement of the presser bar during a second portion of the revolution of the main crankshaft.

11. In a sewing machine of the type including a workpiece support table, a frame from which a first yoke member and a second yoke member extend so that a first surface of the first yoke member substantially faces the workpiece support table and a second surface of the second yoke member substantially faces away from the workpiece support table, a presser bar having a presser foot extending from one end thereof, the presser bar being movably retained in openings formed in the first and second yoke members so that a portion of the presser bar having the presser foot extending therefrom extends between the first surface and the workpiece support table and so that another portion of the presser bar extends through the second surface away from the workpiece support table, and a lift mechanism for moving the presser foot away from the workpiece support table when the lift mechanism is actuated, the improvement comprising:

a latch bar, including:

a latch foot extending therefrom for engaging the first yoke member adjacent the first surface thereof so that said latch bar is secured from moving in a direction away from the workpiece supporting table; and a support arm extending in overlying, spaced relation to the second surface of the second yoke member;

a blocking member connected to said support arm, said blocking member having an inclined surface extending obliquely to the direction of movement of the presser bar;

a decoupling member pivotally connected to said latch bar for pivotation against the first yoke member; and a decoupling rod having a first end pivotally connected to said decoupling member and having a second end pivotally connected to the lift mechanism so that said decoupling member pivots and engages the frame to disengage said latch foot therefrom when the lift mechanism is actuated.

12. An apparatus as defined in claim 11, wherein the improvement further comprises positioning means for orienting said blocking member so that a first portion of the inclined surface extends across the path of movement of the presser bar during a first period of operation of the sewing machine and for shifting said blocking member so that a second portion of the inclined surface extends across the path of movement of the presser bar during a second period of operation of the sewing machine.

* * * * *